US005678819A

United States Patent [19]

Underwood

[11] Patent Number: 5,678,819

[45] Date of Patent: Oct. 21, 1997

[54] THREE-DIMENSIONAL STRATEGY GAME

[76] Inventor: Douglas M. Underwood, 8102 Kingsway Ct., Springfield, Va. 22152

[21] Appl. No.: 677,969

[22] Filed: Jul. 10, 1996

[51] Int. Cl.[6] ..... A63F 3/00

[52] U.S. Cl. ..... 273/241

[58] Field of Search ..... 273/241, 242, 273/243, 260, 261, 262

[56] References Cited

U.S. PATENT DOCUMENTS

| | | | |
|---|---|---|---|
| D. 223,540 | 5/1972 | Kayle | 273/241 X |
| 3,695,614 | 10/1972 | Brisson | 273/241 |
| 3,767,201 | 10/1973 | Harper et al. | 273/241 |
| 3,937,471 | 2/1976 | Brennan | 273/241 |
| 4,883,278 | 11/1989 | Scott | 273/241 |
| 5,112,056 | 5/1992 | Ching | 273/241 |

FOREIGN PATENT DOCUMENTS

| | | | |
|---|---|---|---|
| 2237213 | 5/1991 | United Kingdom | 273/241 |
| 9421342 | 9/1994 | WIPO | 273/241 |

*Primary Examiner*—William E. Stoll
*Attorney, Agent, or Firm*—Jim Zegger, Esq.

[57] ABSTRACT

A three dimensional, two-player strategy game has vertically aligned base, and transparent second and, preferably, third game boards, each game board having a grid pattern defining game board spaces which are vertically congruent, each player having a set of game pieces, and posts maintaining the boards in vertical alignment with said grid patterns vertically congruent. There are a plurality of posts with each post having a stepped shoulder defining a board level for the second game board. The second game board has a plurality of apertures located at grid intersections which are inward of the perimetrical edges of the second game board, the base and third game boards have cavities at corresponding grid intersection positions for snugly receiving the upper and lower ends of the posts, respectively. The grid patterns are M units long and N units wide to define M×N game board spaces, with the game board spaces being sized to receive each game piece individually during the course of a game without impairing visibility of all game pieces on the boards at any given time, and the sets of game pieces are comprised of W major, X number of middle-level and Y number of game pieces, with game pieces being arrayed in predetermined game board spaces starting positions for each player. Each major game piece is movable one game board space at a time in any direction and only in one plane, the middle-level game pieces are moveable one game board space in any direction on the same plane and directly to a game board space directly congruent above or below the game board space it is occupying. The low-level game pieces are moveable one game board space in any non-congruent direction on a different plane, one plane at a time.

12 Claims, 5 Drawing Sheets

THREE-DIMENSIONAL STRATEGY GAME

BACKGROUND OF THE INVENTION

The invention relates generally to a two-player, three-dimensional board game.

Three-dimensional multi-player board games having vertically aligned base and transparent second and third game boards stacked upon one another with grid patterns defining game board spaces are known in the art. Allain U.S. Pat. No. 4,333,654 discloses a multilayer game board in which each game board may be subdivided in as many squares as desired. The number of markers depends upon the number of squares in one direction multiplied by the number of levels. The markers are captured by surrounding either on the same level or in the manner described between levels. Markers cannot be moved between levels except when the marker is on one level or all captured, then the other player can move the "surviving" markers to another level. Lever U.S. Pat. No. 1,877,154 discloses a two-level military game which is in the nature of a chess game with aerial warfare added. Harvey U.S. Pat. No. Des. 242,271 discloses a three-dimensional game board in which two game board levels are spaced by corner and side pylons.

Craig U.S. Pat. No. 5,277,419 discloses a three-layer three-dimensional game board system in which each game board has three rows and three columns of squares and the game boards are stacked upon another with each player having a normal set of pieces and a "star piece" which is distinguished from the normal pieces. The goal in this case is that each player first completes a formation of three straight lines, each with three normal pieces and a star piece randomly selected. It is somewhat in the nature of a three-dimensional tick-tack toe game. Courialis U.S. Pat. No. 5,195,750 relates to a three-dimensional game in which the boards are staggered. Goff U.S. Pat. No. 5,193,813 relates to a three-dimensional chess game played on a cubic playing field in which the number of vertically stacked playing boards equals the number of squares on one dimension. For example, ten boards are mounted over each other and each board defining a 10×10 matrix of 100 squares.

THE PRESENT INVENTION

The object of the present invention is to provide an improved, two-player three-dimensional strategy game. In a preferred embodiment, the game is comprised of three game boards positioned directly above each other. Rigidity is provided to the board supports by providing a plurality (preferably four) of internal support posts which are rigidly secured to the central or second game board and into cavities and the base and top game board. The posts define the levels between game boards with the central or second game board levels being sufficiently spaced (in a preferred embodiment, no less than 4" and no greater than 5") between the base and third game boards to enable the human hand to reach between the game boards and grasp a game piece and move the grasped game piece to a new position and to remove captured game pieces from between the game boards. The intermediate or second game board has a plurality of apertures corresponding in number to the number of posts with the apertures being located at grid intersections which are inward of the perimetrical edges of the second game board. The base and upper levels or third game boards have cavities or openings at corresponding grid intersection positions for snugly receiving the upper and lower levels or ends of the posts, respectively. The grid pattern is M units long and N units wide (M and N both equalling 6 in one preferred embodiment) to define M×N game board spaces (36 game spaces in one preferred embodiment). The game spaces (or grid squares) and the game pieces are sized to receive each game piece individually during the course of the game without impairing visibility of all game pieces on the boards at any given time. The game boards are spaced such that all grid patterns are visible to the players so that they may devise various strategies in order to "capture" the opposing player's game pieces. Each player is provided with a set of game pieces which in the preferred embodiment comprises W [3] major, X [6] number of middle-level and Y [9] number of low-level game pieces. The game pieces are arrayed in a predetermined game board spaces starting position for each player respectively.

In a preferred embodiment, each of the major game pieces are movable one game board space at a time in any direction but only in the plane in which they are initially located. The middle-level game pieces are movable one game board space in any direction on the same plane and directly to a game board space directly congruent above or below the game board space it is occupying. The low-level game pieces are movable non-congruent one game space in any direction on a different plane, one plane at a time.

The usual play is that the opposing player game pieces are captured and removed from the board when a player moves his or her game piece to a game board space occupied by the to-be-captured game piece of the opponent. The game is concluded when one player has captured all of W of the opponent's major game pieces. In the preferred embodiment, a game square can only be occupied by one player's piece at a time. As noted above, if a player moves their piece into a square occupied by their opponent, the opponent's piece is captured and removed from the board. It is in this manner that each player will be able to formulate strategy using their pieces together to capture the opponent's "commanders".

While the preferred embodiment uses three (or more) vertically congruent game boards, junior versions of the game can use two vertically congruent game boards.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
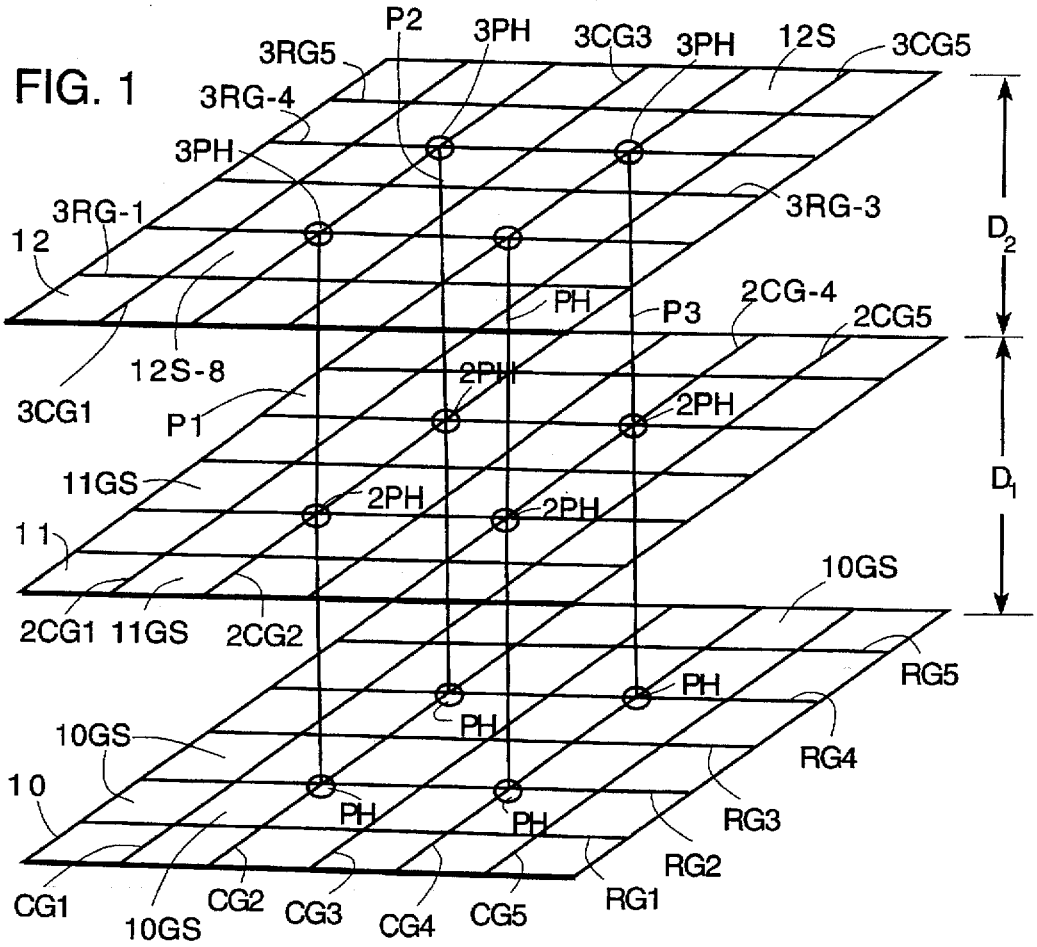
FIG. 1 is a perspective view of the three (base, intermediate and upper) game boards incorporated in the invention.
Figure 4:
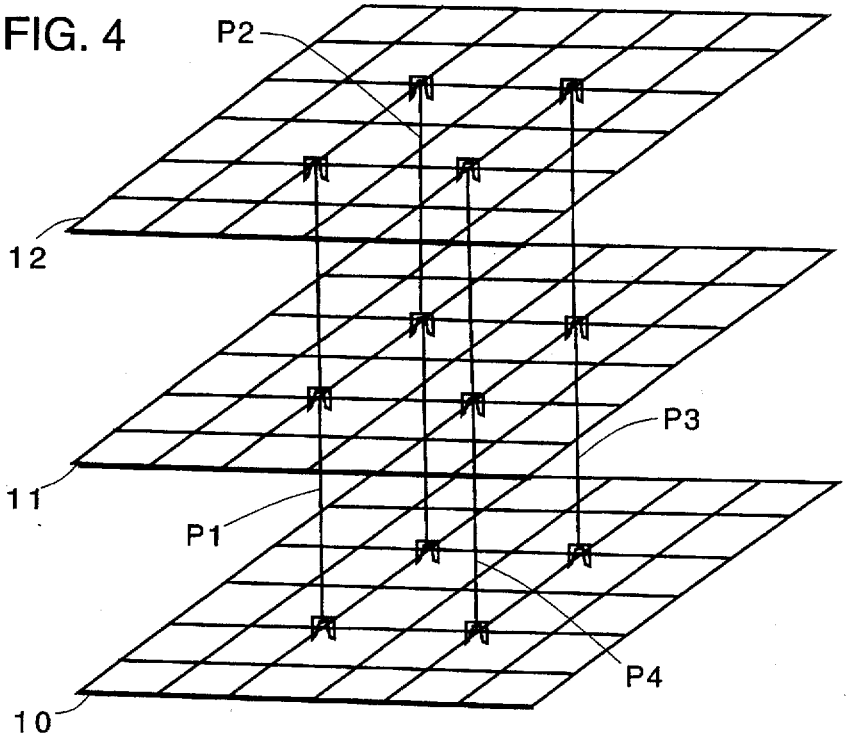
FIG. 4 is a perspective view of the game boards with the posts in place illustrating their preferred positions.

Referring to FIGS. 1, 2 and 4, the game board is comprised of a base game board 10, an intermediate-level game board 11 and in this preferred embodiment an upper game board level 12. Each game board has a grid pattern 10*g*, 11*g* and 12*g* defining game board spaces 10*s*, 11*s* and 12*s* which are vertically congruent with each other. In other words, game board space 10*s*–8, 11*s*–8 and 12*s*–8 are vertically congruent vertically one above or below each other, respectively. Each of the three game boards 10, 11 and 12 in a preferred embodiment are 12"×12" game boards with the grid patterns formed from tape on the bottom of each panel in a six-square by six-square formation with each game board having 36 squares or spaces. The game boards are positioned by four posts P1, P2, P3 and P4; and in a preferred embodiment they are four to five inches apart. That is, the space between game board 10 and game board 11 is four to five inches, and the space between game board 11 and game board 12 is four to five inches. Game boards 11 and 12 are clear plastic, and game board 10 can be clear plastic with a white bottom or the middle and top game board have collars either integrally formed or glued in place for receiving the support columns or posts P1, P2, P3, P4. The support columns or posts can be made out of clear plastic or out of aluminum or the like. As shown in FIG. 2, each post has a stepped shoulder defining a board level for intermediate game board 11 and the four to five inch space defined earlier herein is sufficient spacing between the game board 10 and game board 11 and game board 11 and game board 12 to enable the human hand to reach between the boards and grasp a game piece and move the grasped game piece to a new position to remove or capture opponent's game pieces from the board. Moreover, this spacing arrangement, transparency, as well as the dimensions of the grid pattern and the size of the grid pattern, enable the game to be placed upon a coffee table, for example, for easy viewing by the two players to enable them to formulate their strategy in a facile way.

Figure 2B:
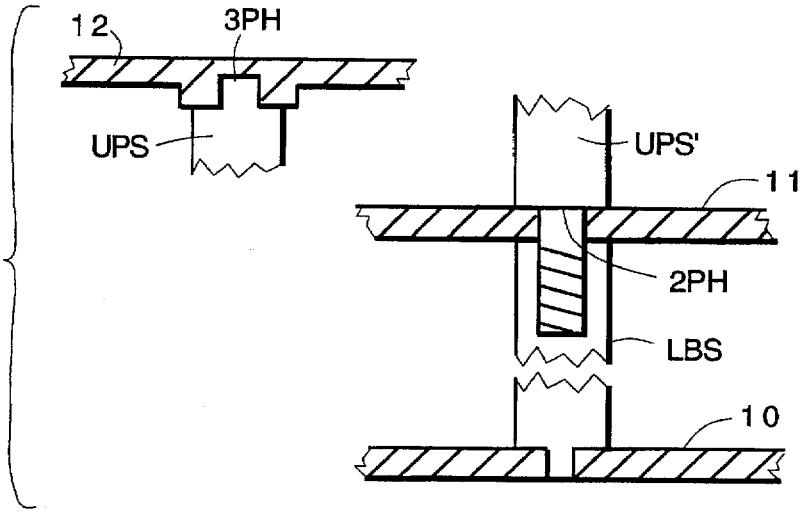
FIG. 2B is a sectional view of a further embodiment of a post supporting the game boards in vertically congruent positions.
Figure 2A:
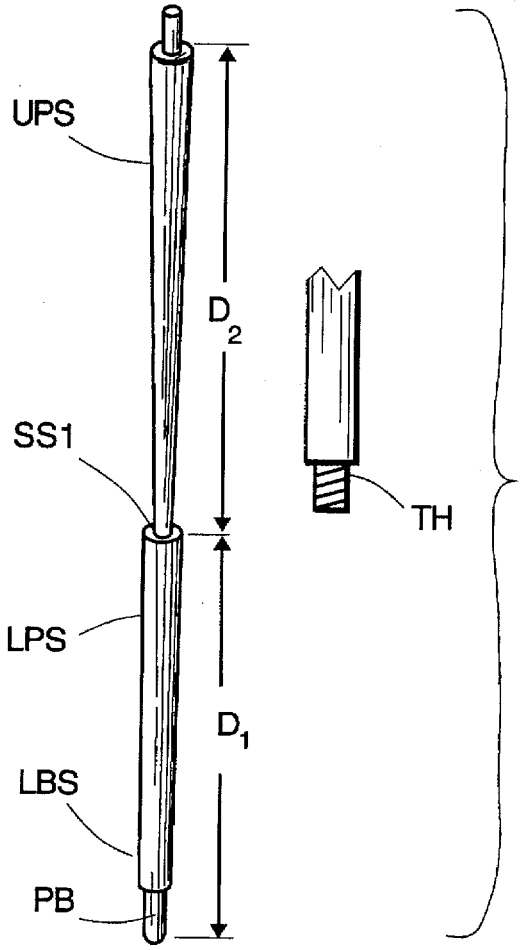
FIG. 2A is a perspective view of one embodiment of a post supporting the game boards in vertically congruent positions.

Exemplary embodiments of the post are shown in FIGS. 2A and 2B. Each post incorporates a stepped shoulder SS which is spaced a distance D above the stepped shoulder LSS which has a pin PB projecting downwardly therefrom for entering into post hole PH in the base or bottom panel 10. The mounting holes PH in base or lower game board panel 10 are located inwardly of the perimetrical edges of the lower game board 10 and preferably at the intersections of column grid line CGL2 and CGL4 with row grid lines RG2 and RG4. By placing the posts inwardly at the perimetrical edges and at the intersections of the above-identified grid lines, the ease of hand movements along the interior and perimetrical edges of the game board are facilitated with less likelihood of the hand striking or bumping against the posts or game boards 10, 11 or 12. While the game board can be made larger or smaller and the squares larger or smaller or increased in number or decreased in number, the preferred embodiment is as illustrated.

Referring again to FIG. 2A, note that the upper post section UPS is tapered, in this embodiment, and fits into a tapered hole TH in the upper end of the lower post section LPS. The intermediate or middle game board 11 is adapted to rest on shoulders SS1 and the lower end of upper post section UPS snugly fits inside apertures PH2, at the intersections of the grid intersections 2CG2, 2CG4 and 2RG2 and 2RG4; and at the same time a tight friction fit in the upper aperture or hole cavity in the end of the lower post sections LD. The idea here is to provide a snug tight fit in the apertures 2PH so as to rigidify the three layers of the game board and at the same time they can be disassembled quickly for storage. It will be appreciated that instead of straight aperture holes 2PH, these holes can be tapered to accommodate the tapering of the upper post sections UPS. Moreover, the upper post sections instead of being tapered can have uniform diameter and instead of being taper friction fit into the upper end of hole on the shoulder SS4 can be threadedly engaged therewith so that when the upper post section UPS' is threadably engaged in the threaded hole HT lower post section LPS' so that the body of the panels 11' is tightly clamped therebetween (by each of the four post assemblies) thereby assuring a strong stable support of the upper panel sections 11 and 12. Three are four posts in the preferred embodiment, and since they are inwardly spaced, there is no sagging of the upper panel sections 11 and 12. This arrangement provides a good, stable and non-wobbly multi-level game board with easy and facile access to inner playing spaces.

THE GAME PIECES/FIGS. 3A 3B AND 3C)

Figure 3A:
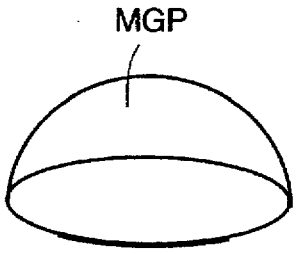
FIG. 3A, 3B and 3C are diagrammatic illustrations of a major game piece (FIG. 3A) which may be called "commander", middle-level game piece shown in FIG. 3B which may be called "striker" and the lower level game piece (FIG. 3C) which may be called "jumper"
Figure 3B:
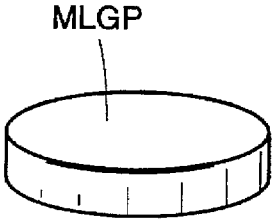
Figure 3C:
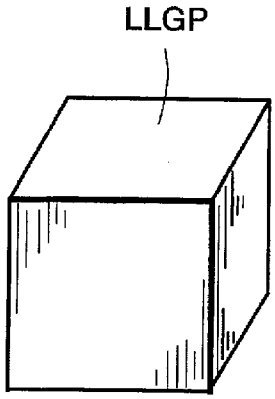

While the game pieces can take many different configurations, simple geometric shapes are illustrated in the present preferred embodiment. As shown in FIG. 3A, the major game piece MGP is a port of a sphere and may be transparent or opaque with varying colors if desired and in a preferred embodiment are called "commanders". The middle-level game pieces MLGP are shown in FIG. 3B and are comprised of short cylindrical members and in a preferred embodiment are called "strikers". The low-level game pieces LLGP are cubes and in this preferred embodiment are called "jumpers". In a preferred embodiment, the major game pieces MGP are about one and one-quarter inch in diameter and about one inch high. The middle-level game pieces are about one inch in diameter and about one-quarter inch high, and the low-level game pieces are one-inch cubes. It will be appreciated that these shapes are purely arbitrary and various other shapes may be assigned to these game pieces to stimulate interest and variety in the games.

Figure 5:
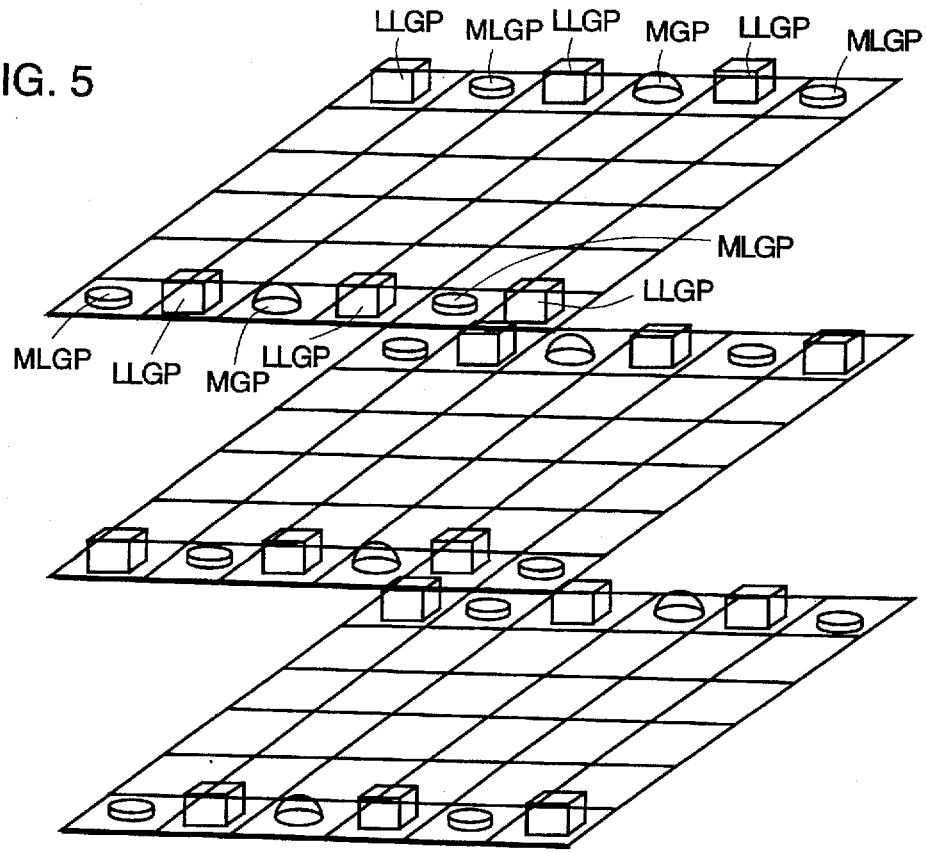
FIG. 5 is an illustrative example of the initial assignment positions of a game piece set for each player in a preferred initial starting position.

In the preferred embodiment, each player will have a set of game pieces preferably of different colors and they may have their name assigned thereto or printed thereon or embossed in the surface so as to remind the user of the major game piece is, for example, a "commander", the middle-level game pieces are "strikers" and the low-level game pieces are the "jumpers". FIG. 5 illustrates an exemplary initial layout or positioning of the opposing player's sets of game pieces. Note that in this embodiment, each side is provided with a set of game pieces and that there are three major (or "commander") game pieces MGP per side and positioned one on each game board playing level 10, 11 and 12. As illustrated, there are assigned to each player in his set of game pieces six middle-level game pieces or "strikers" and each player is assigned nine low-level game pieces or "jumpers".

RULES FOR PIECE MOVEMENT (FIGS. 6, 7 AND 8)

Figure 6:
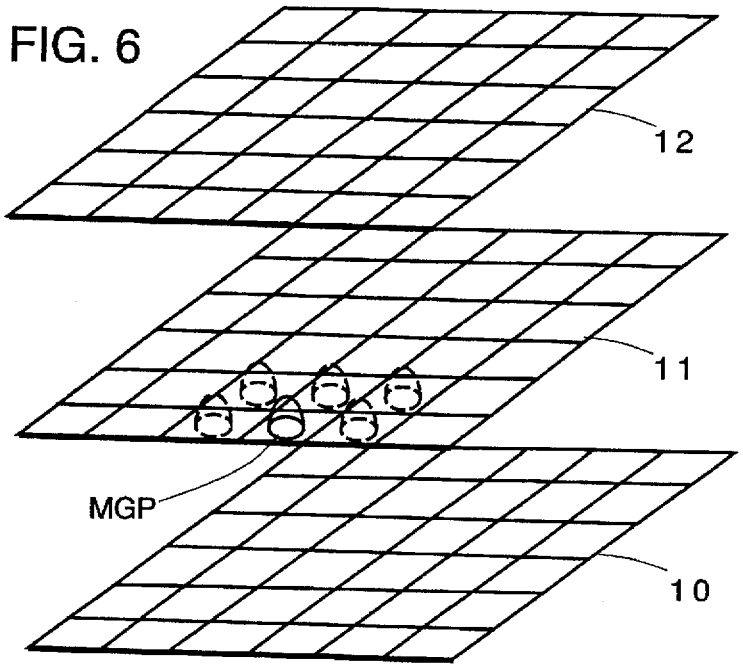
FIG. 6 is a diagrammatic illustration of the major or "commander" movement which moves one game square in any direction on the same plane with the center game board being illustrated with the "commander" moved to one adjacent square in any given direction in the same plane (all of the possible moves being indicated by phantom lines)
Figure 7:
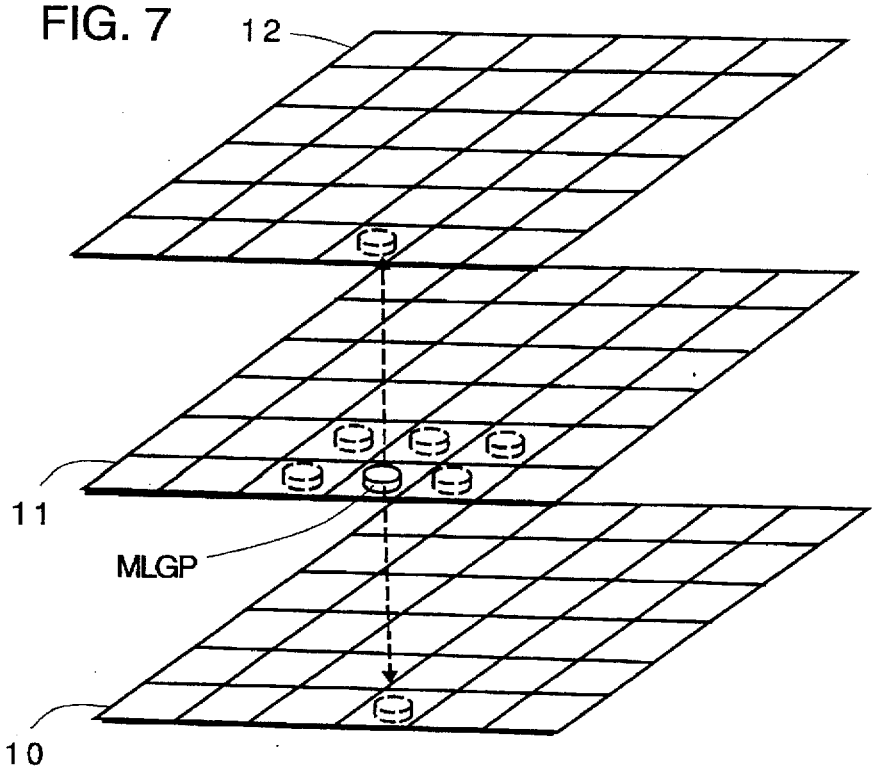
FIG. 7 illustrates the movement of the middle-level game piece (the "striker") which moves one game square in any direction on the same plane or may move to a square directly above or below between planes, the phantom lines indicating all of the possible moves for this game piece.
Figure 8:
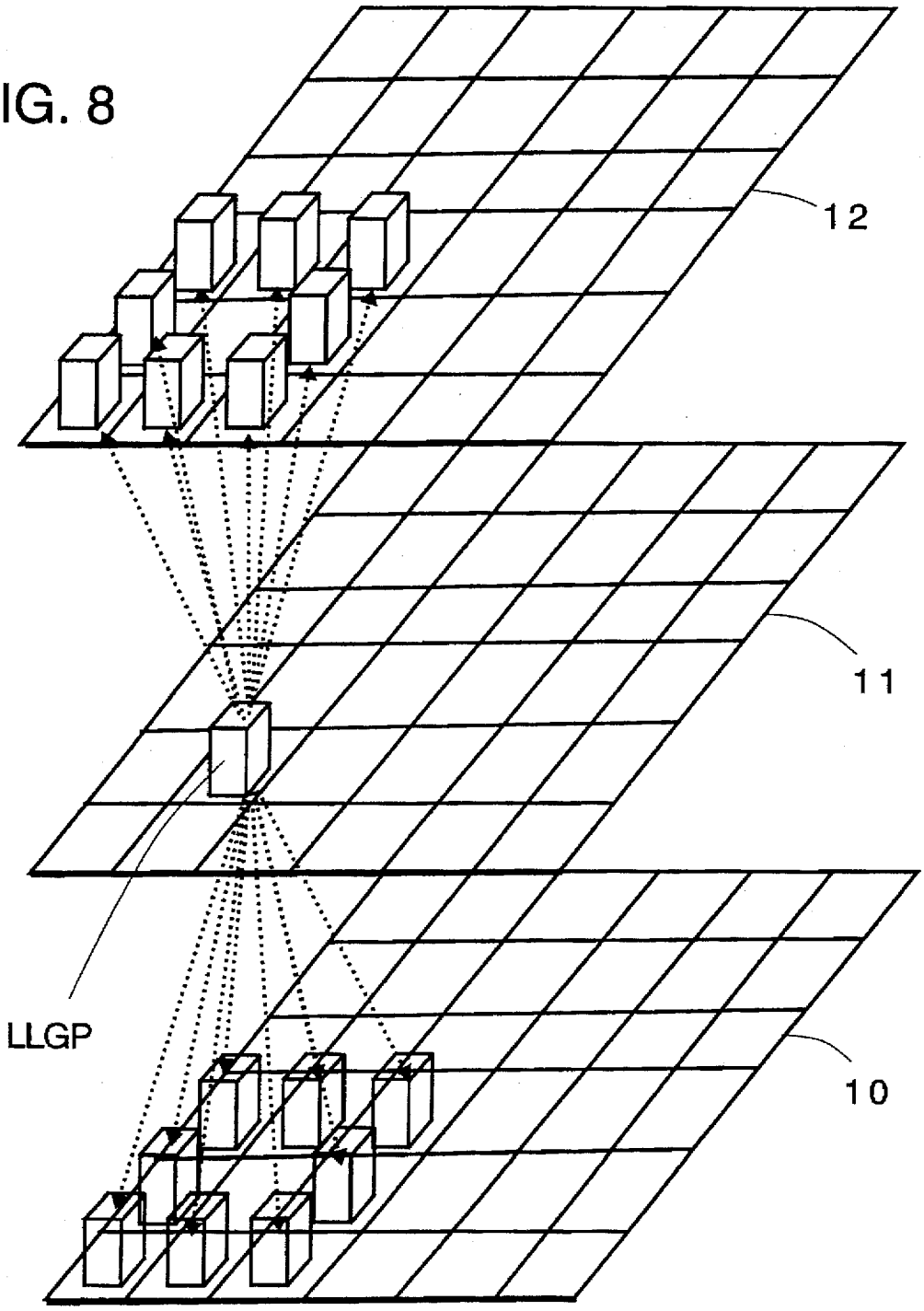
FIG. 8 is an illustration of a range of movement of the low-level game piece ("jumper") which moves one non-congruent game square in any direction or a different plane one level at a time.

The rules for game piece movement are diagrammatically illustrated in FIGS. 6, 7 and 8. FIG. 6 shows the movements for major game piece MGP ("commander"), FIG. 7 shows the movements for the middle-level game pieces MLGP ("striker") and FIG. 8 illustrates the movements for the low-level game pieces LLGP ("jumper"). As shown in FIG. 6, the major game piece movement moves one game square GS in any direction on the same plane. For example, as illustrated in FIG. 6, major game piece MGP2 can move on game board 11 one square in any direction but on the same plane, mainly game board 11. The major game pieces MGP on game boards 10 and 12 may not move between boards.

As diagrammatically illustrated in FIG. 7, the middle-level game piece (MLGP) moves in one game square in any direction on the same plane or they be moved to a square directly above or below. Thus, game piece MGL shown in FIG. 7 on game board 11 may move in the same manner on game board 11 as the major game piece MGP and has additional optional moves to game board 10 and game board 12 but only in the squares directly congruent above and below, respectively, as diagrammatically illustrated in FIG. 7.

The low-level game pieces LGP move one non-congruent game square in any direction on a different level or game board, one game board or one level at a time. Thus, the low-level game LGP shown in FIG. 7 on board 11 may move to any one of eight game squares indicated on game board 10 or any one of eight squares indicated on game board 12. However, a low-level game piece on game board 12 may only move down to those game board spaces on game board 11 to the eight spaces on a different level the next succeeding level. If it is on the border squares of game spaces, then it has only available five spaces that it can be moved to. Likewise, if a low-level game piece LGP is on the lower game board 10, it has the moves that it would have available to it on the board 12 but only in the opposite upward direction.

The object of the game in this embodiment is to capture the opponent's major game pieces ("commanders"). Each player must take a turn moving their pieces one at a time using the rules for piece movement described above in connection with FIGS. 6, 7 and 8. A game square GS can only be occupied by one player's piece at a time. If a player moves their piece into a game square occupied by their opponent, the opponent's game piece occupying that game square is captured and removed from the board. It is in this manner that each player will be able to formulate strategy using their pieces together to capture the opponent's "commanders". The game ends when all three of the opponent's major game pieces ("commanders") are captured or the opponent surrenders. The players may flip a coin to see who goes first or arbitrarily the light-colored pieces may move first. Using the rules for piece movement described above, each player will take a turn, moving one of their pieces during their turn. The rule requires that each player must make a move during their turn. As noted above, a game square GS can only be occupied by one player's game piece at a time. It will be noted that the game pieces in the game squares given in the preferred embodiment described above have been dimensionally designed so that this rule is almost mandatorily followed.

In this preferred embodiment, the game teaches the basic concept of three-dimensional game strategy. Moreover, in the preferred embodiment the game does not attach or affiliate with any country of origin or language of origin, and, preferably, the game will not have a time period associated with it. Furthermore, in the preferred embodiment, the game gives the viewer visual perspective of the game's dimensions and it uses a grid system to define the playing space, and there are no dice used or similar sort of randomizers. The game will have but one object and that is to capture or force the surrender of the opponent's major game pieces MGP.

A junior (and shorter time) version of the game can be played by simply not installing the upper transparent game board 12. The rules of play are essentially the same as described earlier, modified to take into account the reduced number of game boards.

While the invention has been described with reference to preferred embodiments of the invention, it will be appreciated that various other embodiments, adaptations, modifications and variations in the invention will be readily apparent to those skilled in the art.

What is claimed is:

1. In a three-dimensional, two-player strategy game having a vertically aligned base, and transparent second and third game boards, each said game board having a grid pattern defining game board spaces which are vertically congruent, respectively, each player having a set of game pieces, and post means maintaining said boards in vertical alignment with said grid patterns vertically congruent, the improvement comprising:

said post means comprising a plurality of posts with each post having a said stepped shoulder, stepped shoulder defining a board level for said second game board, said board level being sufficiently spaced between said base and third game boards to enable the human hand to reach between boards and grasp a game piece and move the grasped game piece to a new position and to remove captured opponents game pieces from the game boards, said second game board having a plurality of apertures corresponding in number to the number of said posts and being located at grid intersections which are inward of the perimetrical edges of said second game board, said base and third game boards having cavities at corresponding grid intersection positions for snugly receiving the upper and lower ends of said posts, respectively, said grid patterns being M units long and N units wide to define M×N game board spaces, said game board spaces being sized to receive each of said game pieces individually during the course of a game without impairing visibility of all game pieces on said boards at any given time, said game boards being spaced such that all said grid patterns are visible to said players, said grid patterns being formed on the lower surfaces of said second and third transparent game boards, said sets of game pieces being comprised of W major, X number of middle-level and Y number of low level game pieces, said game pieces being arrayed in predetermined game board spaces starting positions for each player, respectively, each said major game piece being movable one game board space at a time in any direction and only in one plane, said middle-level game pieces being moveable one game board space in any direction on the same plane and directly to a game board space directly congruent above or below the game board space it is occupying, and said low-level game pieces being moveable one game board space in any non-congruent direction on a different plane, one plane at a time, whereby an opposing player's game pieces are captured and removed from the board when a player moves game pieces to the game board space occupied by the to-be-captured game piece, and the game is concluded when one player has captured all W of an opponent's major game pieces.

2. The game defined in claim 1 wherein said grid patterns are formed on the lower surfaces of said second and third transparent game boards.

3. The game defined in claim 1 wherein each said post means includes an upper post section and a lower post section, said sections having upper and lower ends, and means on the upper end of said lower post section and the lower end of said upper post section for clamping said second game board to said stepped shoulder.

4. The game defined in claim 3 wherein said game boards are parallel to each other and spaced apart about 4" to 5".

5. The game defined in claim 4 wherein each said game board is about 12" square and said grid pattern units M is 6 and grid pattern unit N is 6 and in said set of game pieces W=3, X=6 and Y=9.

6. The game defined in claim 4 wherein each said game board is about 12" square and said grid pattern units M is 6 and grid pattern unit N is 6 and in said set of game pieces W=3, X=6 and Y=9.

7. A method of play for a three-dimensional, two-player strategy game having a vertically aligned base, and transparent second and third game boards, each said game board having a grid pattern defining game board spaces which are vertically congruent, respectively, each player having a set of game pieces, and post means maintaining said boards in vertical alignment with said grid patterns vertically congruent, comprising:

providing said grid patterns six units long and six units wide to define thirty-six game board spaces, sizing said game board spaces to receive each of said game pieces individually during the course of a game without impairing visibility of all game pieces on said boards at any given time, said game boards being spaced such that all said grid patterns are visible to said players, assigning a set of game pieces with each set including three major, six middle-level and nine low-level game pieces, said game pieces being arrayed in predetermined game board spaces starting positions for each player wherein there is one (1) major game piece on each game board, two (2) middle-level game pieces on each game board and three (3) low-level game pieces on each game board, respectively, each said major game piece being movable one game board space at a time in any direction and only in one plane, each said middle-level game pieces being moveable one game board space in any direction on the same plane and directly to a game board space directly congruent above or below the game board space it is occupying, and each said low-level game pieces being moveable one game board space in any non-congruent direction on a different plane, one plane at a time, whereby an opposing player's game pieces are captured and removed from the board when a player moves game pieces to the game board space occupied by the to-be-captured game piece, and the game is concluded when one player has captured all of an opponent's major game pieces.

8. In a three-dimensional, two-player strategy game having a vertically aligned base and transparent second game boards, each said game board having a grid pattern defining game board spaces which are vertically congruent, respectively, each player having a set of game pieces, and post means maintaining said boards in vertical alignment with said grid patterns vertically congruent, the improvement comprising:

said post means comprising a plurality of posts with each post having a stepped shoulder, defining a space and board level between game boards, said board level being sufficiently spaced between said base and second game boards to enable the human hand to reach between boards and grasp a game piece and move the grasped game piece to a new position and to remove captured opponents game pieces from the game boards, said second game board having a plurality of apertures corresponding in number to the number of said posts and being located at grid intersections which are inward of the perimetrical edges of said game boards, said base and game boards having cavities at corresponding grid intersection positions for snugly receiving the upper and lower ends of said posts, respectively, said grid patterns being M units long and N units wide to define M×N game board spaces, said game board spaces being sized to receive each of said game pieces individually during the course of a game without impairing visibility of all game pieces on said boards at any given time, said game boards being spaced such that all said grid patterns are visible to said players, said grid patterns being formed on the lower surface of said second game board, said sets of game pieces being comprised of W major, X number of middle-level and Y number of low-level game pieces, said game pieces being arrayed in predetermined game board spaces starting positions for each player, respectively, each said major game piece being movable one game board space at a time in any direction and only in one plane, said middle-level game pieces being moveable one game board space in any direction on the same plane and directly to a game board space directly congruent above or below the game board space it is occupying, respectively, and said low-level game pieces being moveable one game board space in any non-congruent direction on a different plane, one plane at a time, whereby an opposing player's game pieces are captured and removed from the board when a player moves game pieces to the game board space occupied by the to-be-captured game piece, and the game is concluded when one player has captured all W of an opponent's major game pieces.

9. The game defined in claim 7 wherein there is at least one additional transparent game board with grid spaces congruent to grid spaces on said base and second game boards.

10. The game defined in claim 9 wherein each said post means includes an upper post section and a lower post section, said sections having upper and lower ends, and means on the upper end of said lower post section and the lower end of said upper post section for clamping said second game board to said stepped shoulder.

11. The game defined in claim 8 wherein said game boards are parallel to each other and spaced apart about 4" to 5".

12. A method of play for a three-dimensional, two-player strategy game having vertically aligned base and transparent second game boards, each said game board having a grid pattern defining game board spaces which are vertically congruent, respectively, each player having a set of game pieces, and post means maintaining said boards in vertical alignment with said grid patterns vertically congruent, comprising:

providing said grid patterns six units long and six units wide to define thirty-six game board spaces, sizing said game board spaces to receive each of said game pieces individually during the course of a game without impairing visibility of all game pieces on said boards at any given time, said game boards being spaced such that all said grid patterns are visible to said players, assigning a set of game pieces with each set including three major, six middle-level and nine low-level game pieces, said game pieces being arrayed in predetermined game board spaces starting positions for each player wherein there is one (1) major game piece on each game board, two (2) middle-level game pieces on each game board and three (3) low-level game pieces on each game board, respectively, each said major game piece being movable one game board space at a time in any direction and only in one plane, each said middle-level game piece being moveable one game board space in any direction on the same plane and directly to a game board space directly congruent above or below the game board space it is occupying, and each said low-level game piece being moveable one game board space in any non-congruent direction on a different plane, one plane at a time, whereby an opposing player's game pieces are captured and removed from the board when a player moves game pieces to the game board space occupied by the to-be-captured game piece, and the game is concluded when one player has captured all of an opponent's major game pieces.

* * * * *